US009299518B2

(12) United States Patent
Biedunkiewicz et al.

(10) Patent No.: US 9,299,518 B2
(45) Date of Patent: Mar. 29, 2016

(54) ROTOR FOR AN ELECTRIC SWITCH

(71) Applicant: SIEMENS AKTIENGESELLSCHAFT, Munich (DE)

(72) Inventors: Pawel Biedunkiewicz, Berlin (DE); Jörg-Uwe Dahl, Werder (DE); Christoph Weber, Ergoldsbach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 325 days.

(21) Appl. No.: 13/975,594

(22) Filed: Aug. 26, 2013

(65) Prior Publication Data

US 2014/0061015 A1 Mar. 6, 2014

(30) Foreign Application Priority Data

Aug. 29, 2012 (DE) ..... 10 2012 215 321
May 7, 2013 (DE) ..... 10 2013 208 373

(51) Int. Cl.
*H01H 19/36* (2006.01)
*H01H 1/20* (2006.01)
*H01H 73/04* (2006.01)

(52) U.S. Cl.
CPC ..... *H01H 19/36* (2013.01); *H01H 1/205* (2013.01); *H01H 1/2041* (2013.01); *H01H 73/045* (2013.01)

(58) Field of Classification Search
CPC ..... H01H 1/20; H01H 1/2041; H01H 1/205; H01H 73/045
USPC ..... 200/336, 244–250, 400, 401
See application file for complete search history.

(56) References Cited

U.S. PATENT DOCUMENTS

| | | | | |
|---|---|---|---|---|
| 2,588,632 | A | 3/1952 | Jeffrey | |
| 4,910,485 | A | 3/1990 | Bolongeat-Mobleu et al. | |
| 5,281,776 | A | 1/1994 | Morel et al. | |
| 5,310,971 | A | 5/1994 | Vial et al. | |
| 6,310,307 | B1 | 10/2001 | Ciarcia et al. | |
| 7,977,592 | B2 * | 7/2011 | Shmukler et al. | 200/244 |
| 2009/0065341 | A1 | 3/2009 | Shmukler et al. | |
| 2013/0118870 | A1 * | 5/2013 | Kalous et al. | 200/308 |

FOREIGN PATENT DOCUMENTS

| | | | |
|---|---|---|---|
| DE | 386387 | C | 12/1923 |
| DE | 69209972 | T2 | 10/1996 |

(Continued)

OTHER PUBLICATIONS

DE01 Search Report dated Jul. 11, 2013.

*Primary Examiner* — Amy Cohen Johnson
*Assistant Examiner* — Marina Fishman
(74) *Attorney, Agent, or Firm* — Harness, Dickey & Pierce, P.L.C.

(57) ABSTRACT

A rotor for an electric switch is disclosed. In an embodiment, the rotor includes a rotor housing and a rotatably mounted contact bridge, which exhibits two movable contacts, wherein, by the rotation of the rotor, the two movable contacts can interact with two fixed contacts of an electric switch for closing or opening a circuit. The rotatably mounted contact bridge in the rotor housing is movably mounted in a direction perpendicular to the direction of the contact bridge in its closed position.

20 Claims, 8 Drawing Sheets

(56) References Cited

FOREIGN PATENT DOCUMENTS

| | | | |
|---|---|---|---|
| DE | 69304374 | T2 | 2/1997 |
| DE | 102008049442 | A1 | 4/2010 |
| DE | 102010035625 | A1 | 3/2012 |
| EP | 0174904 | A1 | 3/1986 |
| EP | 0560697 | A1 | 9/1993 |
| EP | 0889498 | A2 | 1/1999 |

* cited by examiner

ROTOR FOR AN ELECTRIC SWITCH

PRIORITY STATEMENT

The present application hereby claims priority under 35 U.S.C. §119 to German patent application numbers DE 102012215321.7 filed Aug. 29, 2012 and DE 102013208373.4 filed May 7, 2013, the entire contents of each of which are hereby incorporated herein by reference.

FIELD

At least one embodiment of the invention generally relates to the field of switching devices for the switching of electric currents.

BACKGROUND

Switching devices for the switching of electric currents typically comprise at least one contact system and other housing elements. The contact system forms an electric switch and serves to switch electric currents. One class of switching devices are referred to as "circuit-breakers", which can typically switch currents of 100 A and more. These circuit-breakers comprise a housing, in which the individual phases of the currents are switched. The individual phases of the currents can be located in pole cassettes, which are enclosed in their own housing. Located in the pole cassettes are moveable and fixed contacts, which can be mechanically separated or grouped together respectively, to switch the currents off and on respectively. At the separation of moveable and fixed contacts of a pole cassette, an arc occurs, which is typically extinguished in an "arcing chamber". Circuit-breakers are likewise known which do not contain pole cassettes, and which accommodate movable and fixed contacts in their housings.

In circuit-breakers it is necessary, in order to achieve a good current limitation, to rapidly build up a high arc voltage. This is achieved with what are referred to as "double contact elements", which subdivide the contact gap twice and so create two arcs simultaneously in the event of a short-circuit. The arc voltage produced by the arc is now available twice over in the same time unit, which improves the current limitation in comparison with simple circuit-breaking systems. Typically, with what are referred to as "double contact elements", two electrical contacts are arranged on a rotatably-mounted contact bridge, which represent the moveable contacts. The two moveable contacts interact with two fixed contacts of the electric switch in order to close or open the circuit.

DE 692 09 972 T2 describes a circuit-breaker which includes single-pole units. With this circuit-breaker, the contact bridge of each pole cassette is mounted hanging freely in a switching shaft section, and the rigid mechanical connection between the individual switching shaft sections is effected by means of two rods arranged parallel to the switching shaft and eccentrically in relation to its axis of rotation. This arrangement guarantees the imposition of the contact force, the dynamic contact opening of the electric switch in the event of a short-circuit, and the coupling to a switch mechanism for opening and closing the electric switch with a handle.

In DE 693 04 374 T2 a circuit-breaker is disclosed with a press-molded housing with delay at the movement end of the contact bridge rejection. The contact bridge is mounted in the rotor housing without an axle. To achieve this, the contact bridge comprises tension springs, which in the switched-on position of the circuit-breaker, serve to guarantee that a pressure force is exerted by the contact bridge onto the fixed contacts, and at the same time allow for a rotation of the contact bridge under the effect of the electrodynamic forces in the direction of the rejection-open position.

Double-break contact systems with a rotational arrangement are very frequently prone to asymmetries. The reason for the asymmetries may lie in the tolerance position of the components, or, respectively, in the asymmetric erosion during operation. For example, the contact elements of the contact bridge may burn asymmetrically. These asymmetries lead to unequal contact forces and contact resistances at the contact points. Possible solutions known hitherto for avoiding these asymmetries make provision for a compensation possibility by the movable contact bridge, as well as by a floating arrangement of the switching shaft or, respectively, of the rotor in the pole cassette.

SUMMARY

A rotor for an electric switch is provided, with an alternative solution for the compensation of asymmetries of its contact bridge.

The rotor for an electric switch comprises a rotor housing and a rotatably-mounted contact bridge, which comprises two movable contacts, wherein, by rotation of the rotor, the two movable contacts can interact with two fixed contacts of an electric switch in order to close or open a circuit. The rotatably-mounted contact bridge is mounted so as to be moveable in the rotor housing in a direction perpendicular to the direction of the contact bridge in its closed position. It is advantageous in this situation that the contact forces are better balanced out than with conventional solutions, even in the event of major asymmetries due to tolerances and burnup. Asymmetrical contact resistances are reduced, and it is ensured that an equal burnup occurs on the load side as on the connection side of the electric switch.

In an embodiment, the rotatably-mounted contact bridge is movably mounted in the rotor housing in a direction perpendicular to the axis of rotation of the contact bridge.

In a further embodiment, the rotor for an electric switch further comprises a first plate in the interior of the rotor, which is arranged essentially parallel to the contact bridge, two pairs of first and second spring pins and two pairs of first and second springs. The first ends of the respective pairs of springs are secured to the first spring pins, and the first spring pins lie on the contact bridge and the first plate, while the second ends of the respective pairs of springs are secured to the second spring pins, and the second spring pins are secured to the first plate, such that, in the closed position of the rotor, a minimum contact pressure of the movable contacts of the contact bridge onto the fixed contacts is guaranteed, wherein the second spring pins are movably mounted in the rotor.

In an embodiment, the rotor for an electric switch further comprises a second plate in the interior of the rotor housing, which is arranged essentially parallel to the contact bridge and to the first plate, wherein the first spring pins lie on the contact bridge and on the first and second plate, and wherein the second ends of the respective pairs of springs are secured to the second spring pins, and the second spring pins are secured to the first and second plate.

In an embodiment of the invention, the two pairs of first and second springs are formed as tension springs.

In a further embodiment of the invention, the plates and the contact bridge exhibit a middle recess, through which a guide pin can be guided, which functions as the axis of rotation of the rotor. The middle recess can be formed as a longitudinal hole along a direction perpendicular to the direction of the contact bridge in the closed position.

In an embodiment of the invention, the two plates are connected to one another by means of a connection tube, and the connection tube is guided through the middle recess of the contact bridge.

The rotor can further comprise a guide pin as an axis of rotation of the rotor, which is guided through the connection tube. The diameter of the guide pin can be formed as so small in comparison with the internal diameter of the connection tube such that the guide pin can be mounted eccentrically in the connection tube.

In a further embodiment of the invention, the second spring pins are in each case mounted in a notch of the rotor. This notch can be formed in such a way that the second spring pins are movably mounted in a direction perpendicular to the direction of the contact bridge in the closed position.

In an embodiment of the invention, the second spring pins are mounted floating in the rotor. Likewise, the two plates can be mounted floating in the rotor.

The rotor according to an embodiment of the invention can be part of an electric switch which additionally comprises two fixed contacts, wherein the rotor interacts with the two fixed contacts in order to close or open a circuit.

BRIEF DESCRIPTION OF THE DRAWINGS

Embodiments of the invention are described hereinafter on the basis of the following figures.

DETAILED DESCRIPTION OF THE EXAMPLE EMBODIMENTS

Figure 1A:
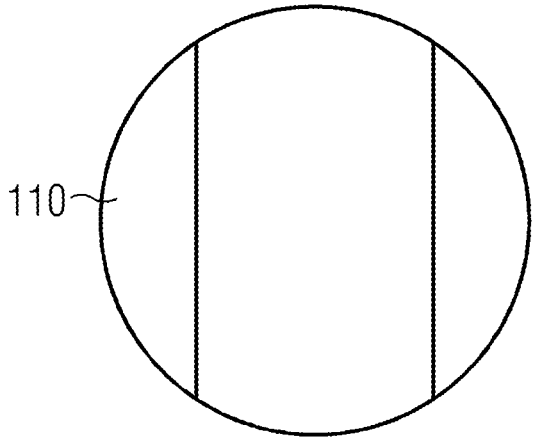
FIG. 1A, 1B, 1C rotor housing, contact bridge, and floating mounted contact bridge.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Figure 1B:
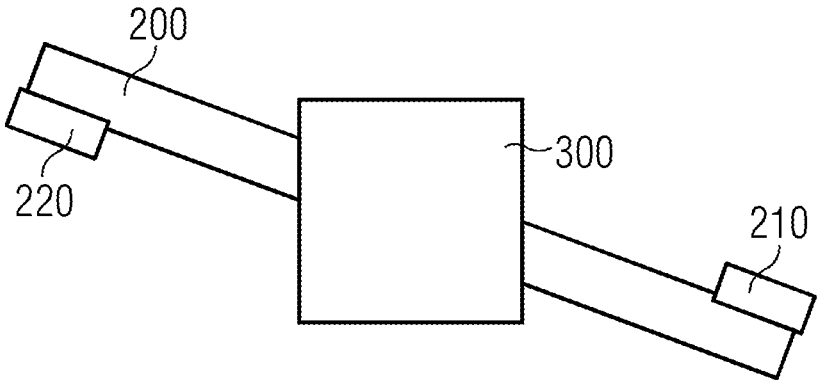
Figure 1C:
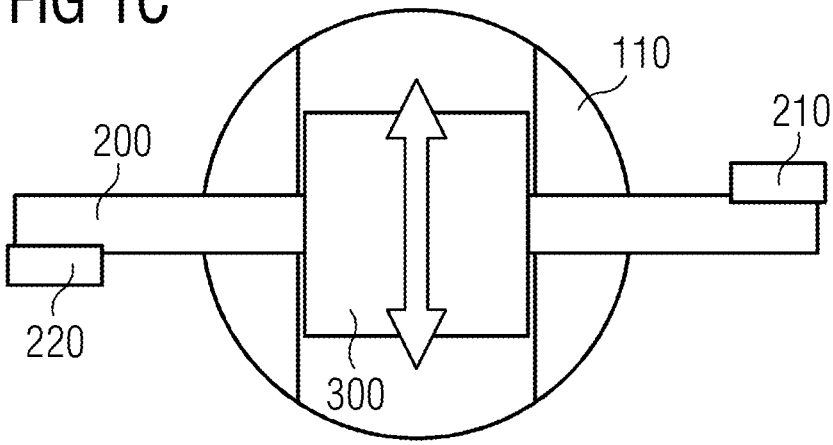

In FIGS. 1A, 1B and 1C a rotor housing 110 for an electric switch is shown, and a rotatably mounted contact bridge 200, which comprises two movable contacts 210, 220. By the rotation of the rotor and the rotor housing 110 respectively, the two movable contacts 210, 220 can interact with two fixed contacts of an electric switch for closing or opening a circuit. The rotatably mounted contact bridge 200 is movably mounted in the rotor housing 110 in a position perpendicular to the direction of the contact bridge 200 in its closed position. In accordance with FIG. 1C, this means that the rotatably mounted contact bridge 200 is arranged in the rotor housing 110 movable in the direction of the arrow.

The rotatably mounted contact bridge 200 can be mounted in a suspension device 300, which in turn is movably mounted in the rotor housing 110.

The rotatably mounted contact bridge 200 is likewise movably mounted in the rotor housing 110 in a direction perpendicular to the axis of rotation of the contact bridge 200.

Figure 2:
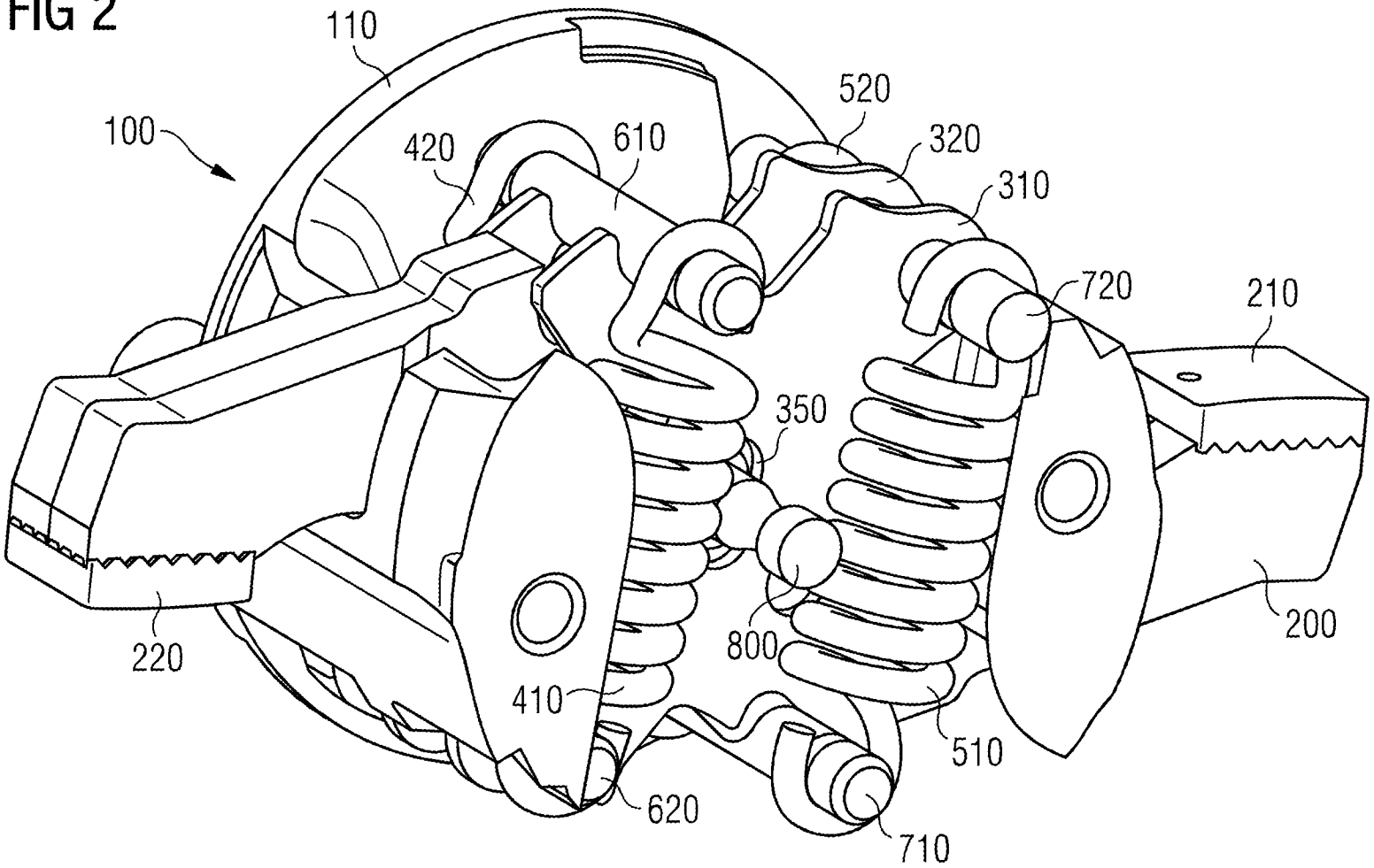
FIG. 2 rotor with contact bridge, two plates, two pairs of first and second spring pins, and two pairs of first and second springs.

Shown in FIG. 2 is a rotor 100 for an electric switch. The rotor 100 comprises a rotor housing 110 and a rotatably mounted contact bridge 200. Located on the contact bridge 200 are two movable contacts 210, 220. By the rotation of the rotor 100, the two movable contacts 210, 220 interact with two fixed contacts 2100, 2200 of an electric switch, to close or open a circuit.

The rotor 100 further comprises a first and second plate 310, 320, which are located in the interior of the rotor 100 and which are arranged essentially parallel to the contact bridge 200. Arranged between these two plates 310, 320 is the rotatably mounted contact bridge 200. The suspension mechanism of the contact bridge 200 in the rotor 100 is explained in greater detail hereinafter.

The rotor 100 comprises for this purpose two pairs of first and second spring pins 610, 710; 620, 720 and two pairs of first and second springs 410, 420; 510, 520. The first ends of the respective pairs of springs 410, 420; 510, 520 are secured to the first spring pins 610, 710. These first spring pins 610, 710 lie on the contact bridge 200 and likewise on the first and second plates 310, 320. The second ends of the respective pairs of springs 410, 420; 510, 520 are secured to the second spring pins 620, 720. These are secured in turn to the plates 310, 320, such that, in the closed position of the rotor 100, a minimum contact pressure of the movable contacts 210, 220 of the contact bridge 200 onto the fixed contacts 2100, 2200 is guaranteed.

The rotatably mounted contact bridge 200 is rotated anticlockwise by the tension of the first and second pairs of springs 410, 420; 520, 520 onto the first spring pins 610, 710, in accordance with the representation in FIG. 2. Accordingly, for example, the movable contact 220 is moved downwards, and the movable contact 210 upwards, in accordance with the representation in FIG. 2, and thereby a minimum contact pressure onto the fixed contacts is guaranteed.

The second spring pins 620, 720, which are secured to the first and second plates 310, 320, are movably mounted in the rotor 100.

Figure 3:
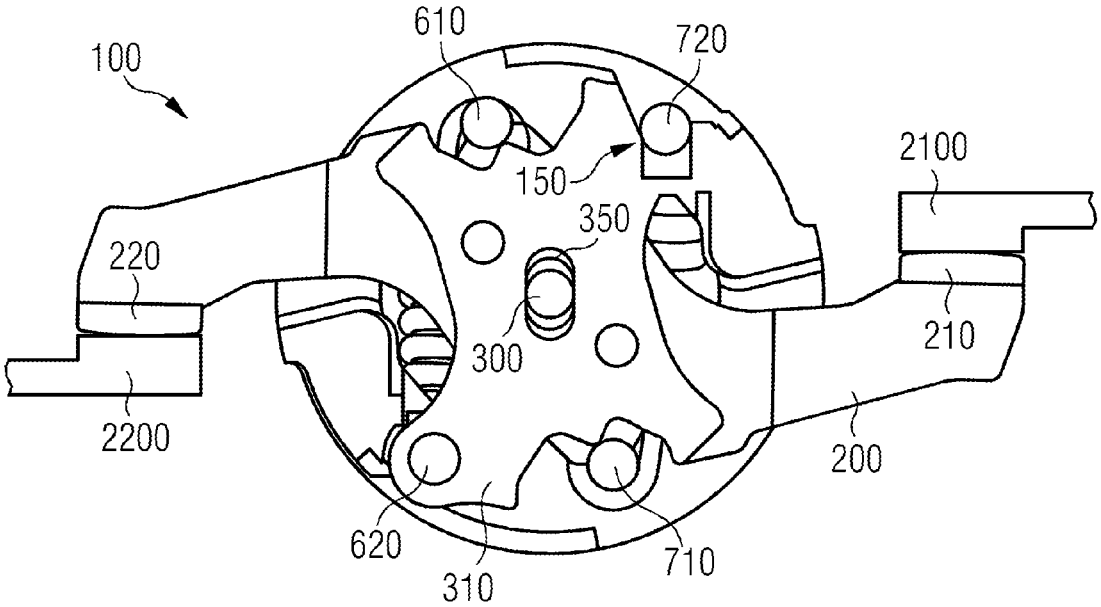
FIG. 3 rotor according to FIG. 1 in a side view.

In FIG. 3 the movable mounting of the second spring pins 620, 720 is explained in greater detail. The second spring pins 620, 720 are in each case mounted in a notch 150 of the rotor 100. Together with the mounting of the contact bridge 200 in the electric switch by the guide pin 800, which is guided through a middle recess 350 of the two first and second plates 310, 320 and of the contact bridge 200, the notches 150 allow for the contact bridge 200 in the closed position to be movable perpendicular to this direction. In accordance with the representation in FIG. 3, this means that the contact bridge 200 with the movable contacts 210, 220 can move upwards and downwards, and thereby tolerances—for example in the contact elements of the contact bridge 200—can be compensated.

The middle recess 350 is formed as a longitudinal hole, which is formed along a direction perpendicular to the direction of the contact bridge 200 in the closed position.

Figure 4:
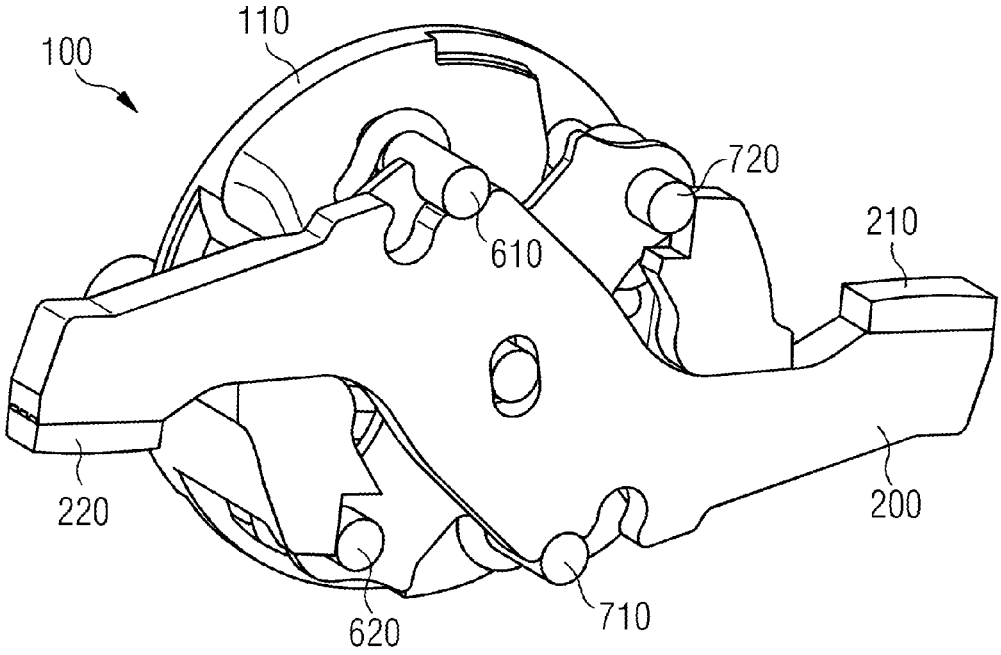
FIG. 4 rotor according to FIG. 1 in a first representation.
Figure 5:
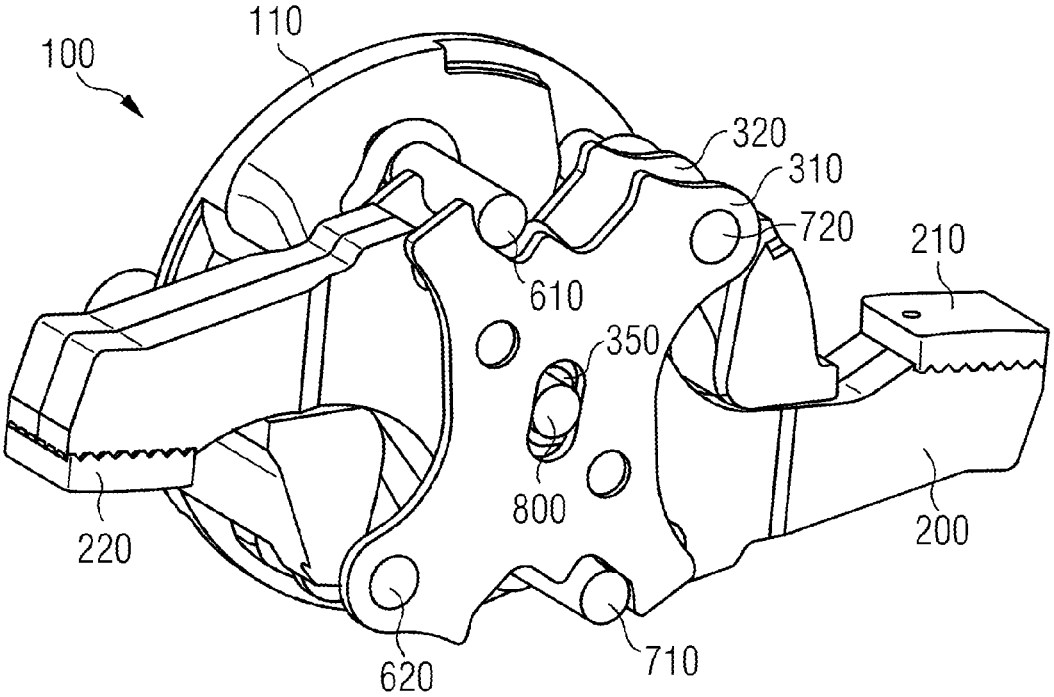
FIG. 5 rotor according to FIG. 1 in a second representation.

Represented in FIG. 4 is the rotor 100 with the contact bridge 200 and the first and second spring pins 610, 710; 620, 720. FIG. 5 shows the rotor 100 in another sectional representation different from FIG. 2, 3 or 4.

Figure 6:
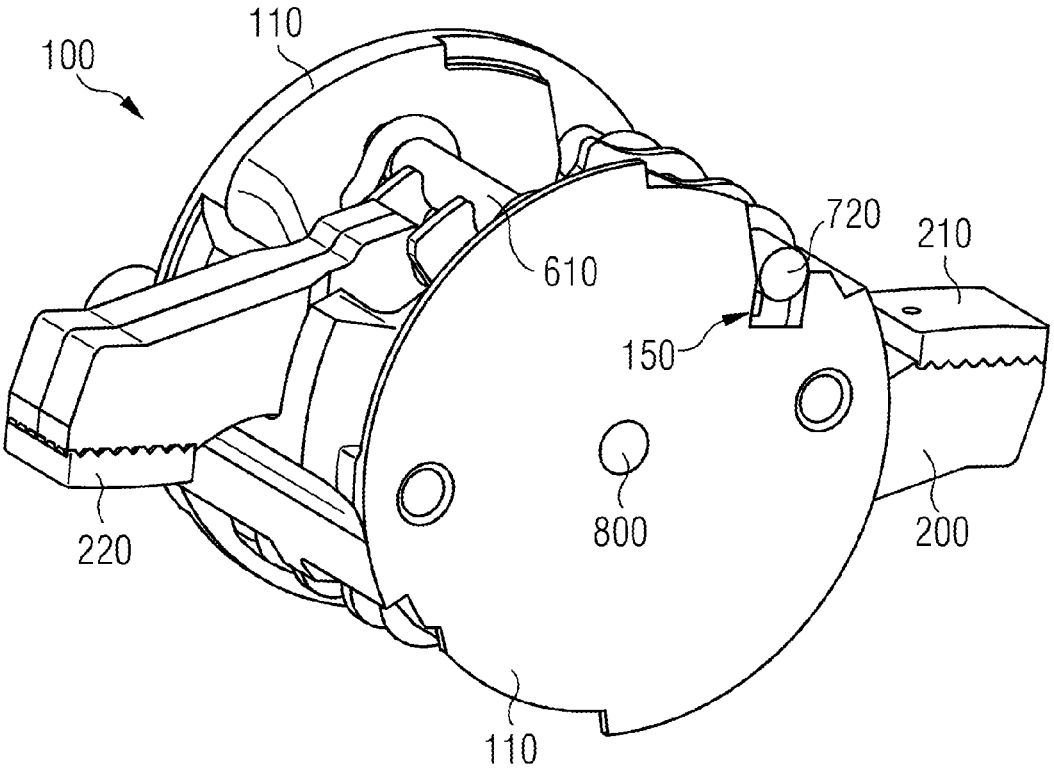
FIG. 6 rotor according to FIG. 1 in a third representation.

FIG. 6 again shows the rotor 100 with the notch 150 in the rotor, which allows the contact bridge 200 together with the two plates 310, 320 to be movably mounted in the rotor 100. The second spring pins 620, 720 are therefore mounted floating in the rotor 100. Thereby, in turn, the two plates 310, 320 are likewise mounted floating in the rotor 100.

The two pairs of first and second springs 410, 420; 510, 520 are formed in this example embodiment as tension springs. The pairs of first and second springs 410, 420; 510, 520 run from the first spring pins 610, 710 to the second spring pins 620, 720 parallel to the two plates 310, 320. According to the embodiment shown, the first and second springs 410, 420; 510, 520 run outside the two plates 310, 320.

Figure 7:
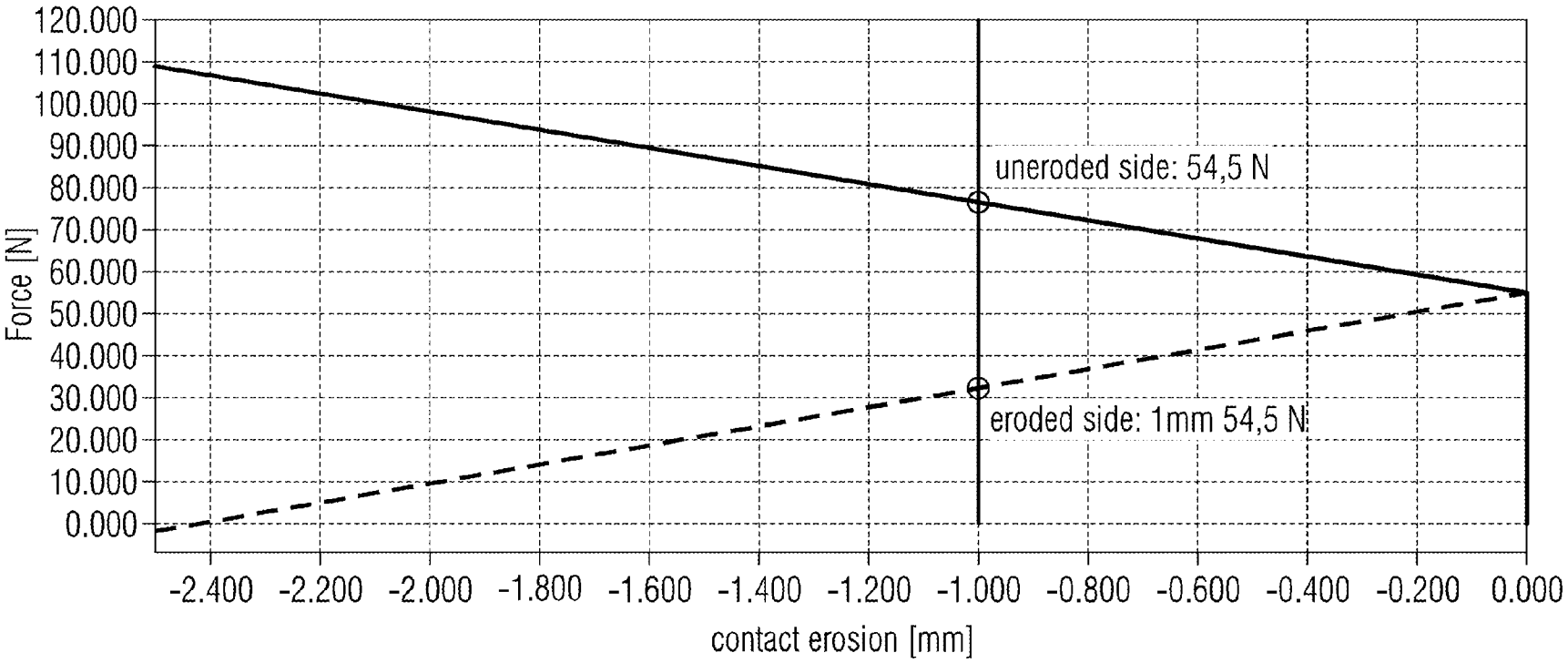
FIG. 7 force-erosion diagram of a rotor according to an embodiment of the invention.

Shown in FIG. 7 is a force-erosion diagram. Due to the fact that the floating mounted second spring pins 620, 720 allow for a movement of the rotatably mounted contact bridge 200, the same contact force is exerted on both the movable contacts 210, 220, regardless of the degree of erosion of the contact elements.

Figure 8A:
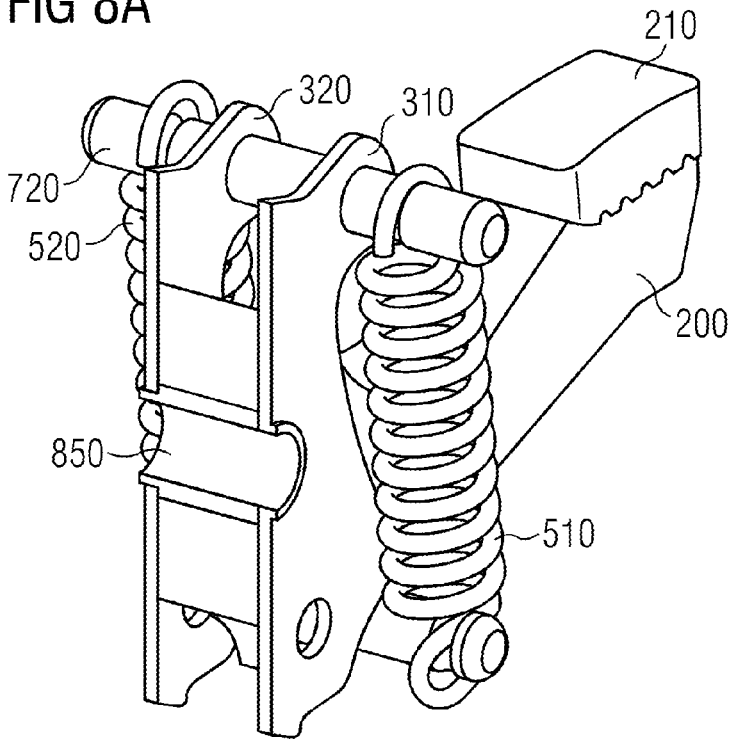
FIG. 8A, 8B rotor housing, contact bridge, and plates connected by a connection tube.
Figure 8B:
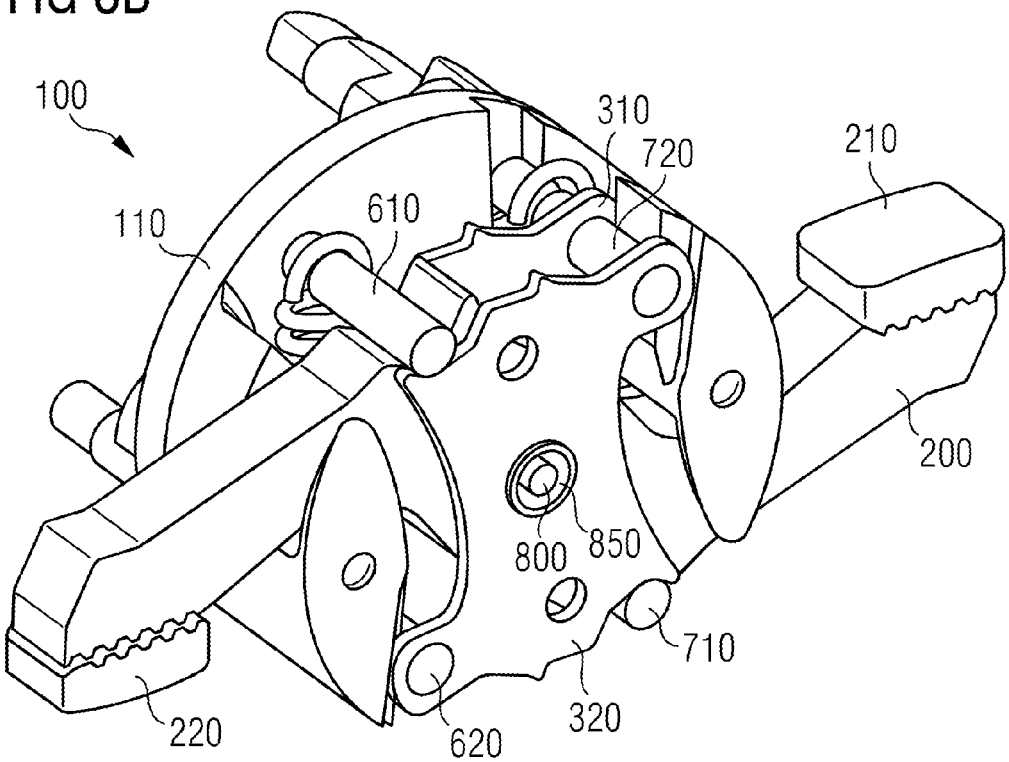

Shown in FIGS. 8A and 8B are the first and second plates 310, 320, which are connected to each other by a connection tube 850. The connection tube 850 is guided through the middle recess 350 of the contact bridge 200.

A guide pin 800 serves as the axis of rotation of the rotor 100. The guide pin 800 is guided through the connection tube 850. The diameter of the guide pin 800 can be formed so small in comparison with the internal diameter of the connection tube 850 that the guide pin 800 can be mounted eccentrically in the connection tube 850.

Figure 9A:
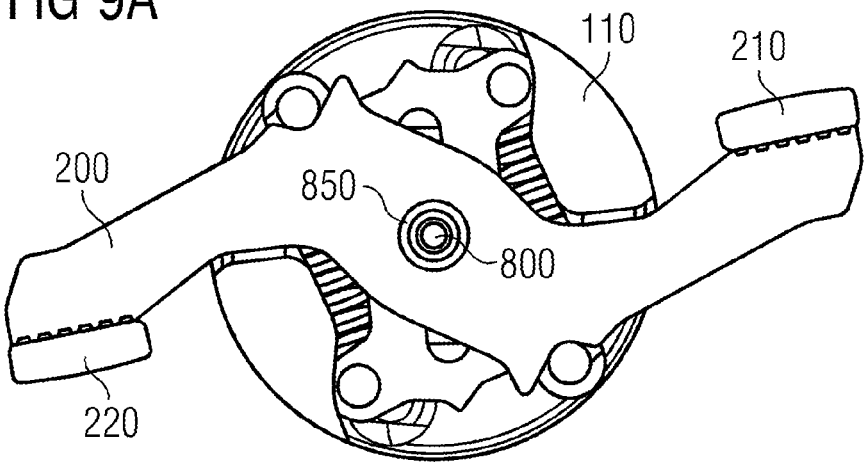
FIG. 9A, 9B, 9C rotor housing, contact bridge and plates connected by connection tubes.
Figure 9B:
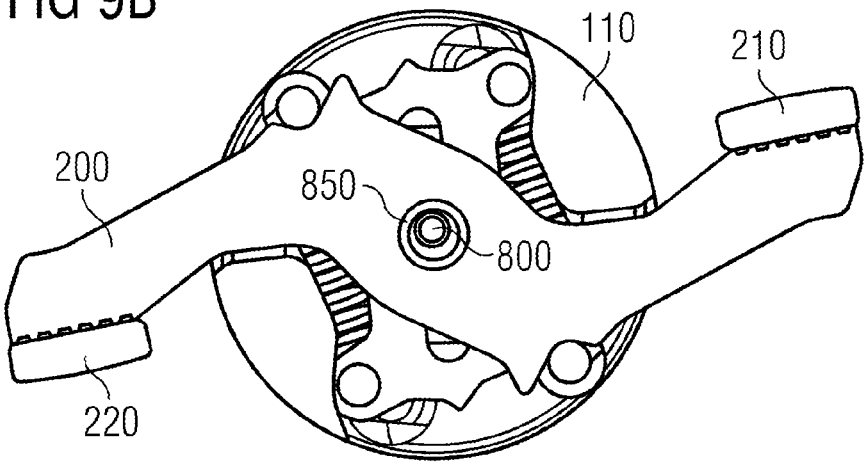
Figure 9C:
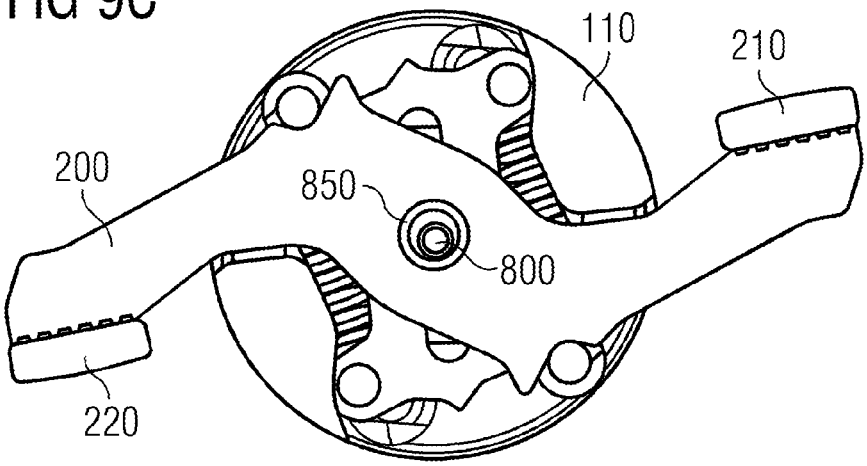

This is shown in greater detail in FIGS. 9A, 9B and 9C. In FIG. 9A, the guide pin 800 is located centrally in the connection tube 850, and accordingly no compensation movement takes place. The situation is different in FIGS. 9B and 9C, where the guide pin 800 is mounted eccentrically in the connection tube 850, and the contact bridge 200 compensates for asymmetries in the arrangement by floating.

Figure 10A:
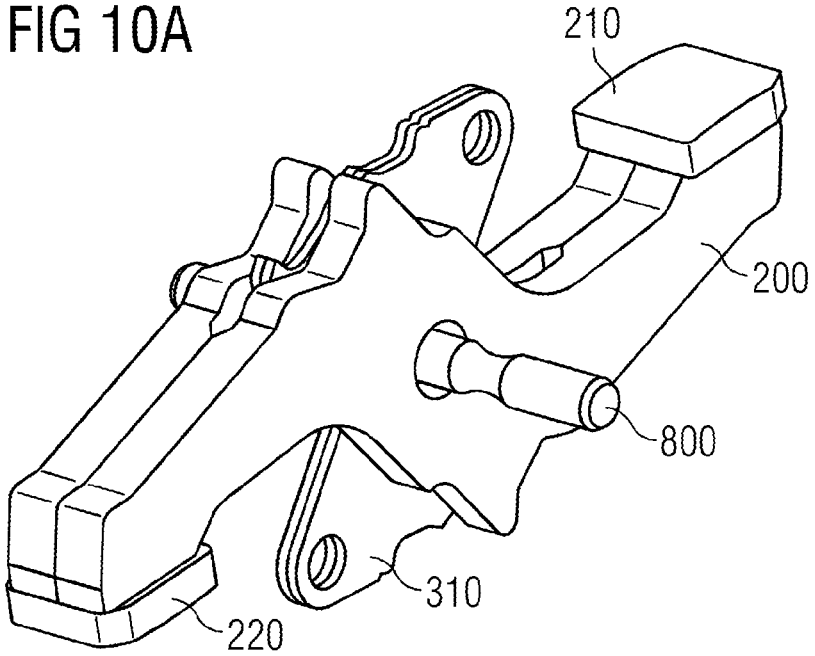
FIG. 10A, 10B contact bridge with a plate.
Figure 10B:
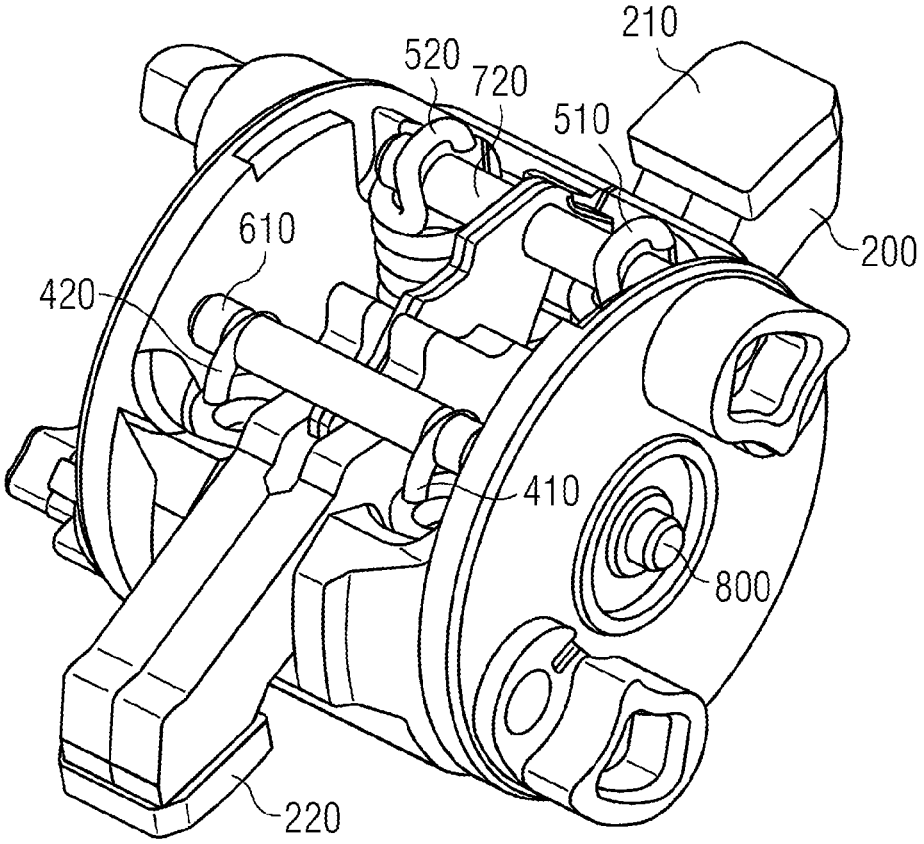

Shown in FIGS. 10A and 10B is the rotor 100 with a first plate 310. This is located in the interior of the rotor 100, and is arranged essentially parallel to the contact bridge 200. The contact bridge 200 has a middle recess, in which the first plate 310 is inserted. The first plate 310 and contact bridge 200 are rotatable about the guide pin 800. The contact bridge 200 can likewise be formed as two pieces, with a recess for the first plate 310.

Shown in FIG. 10B are the two pairs of first and second spring pins 610, 710; 620, 720 and the two pairs of first and second springs 410, 420; 510, 520. The first ends of the respective pairs of springs 410, 420; 510, 520 are secured to the first spring pins 610, 710, and the first spring pins 610, 710 lie on the contact bridge 200 and the first plate 310. The second ends of the respective pairs of springs 410, 420; 510, 520 are secured to the second spring pins 620, 720, and the second spring pins 620, 720 to the first plate 310, such that, in the closed position of the rotor 100, a minimum contact pressure of the movable contacts 210; 220 of the contact bridge 200 onto the fixed contacts 2100; 2200 is guaranteed, wherein the second spring pins 620, 720 are movably mounted in the rotor housing.

The rotor 100 according to an embodiment of the invention can be part of an electric switch, wherein this additionally comprises two fixed contacts 2100, 2200. The rotor 100 with the two movable contacts 210, 220 can interact with the two fixed contacts 2100, 2200 for the closing or opening of a circuit.

Hitherto, the contact bridge has usually been mounted in a fixed position in the rotor. Compensation for different spring lengths with different tolerances of the components, or different lever arms due to a different burnup of the contacts, is provided according to an embodiment of the invention by a floating mounting of the plates 310, 320, which carry the contact bridge 200.

The plates arranged laterally to the contact bridge are connected to one another by the introduction of a connection tube. This creates a stable inner rotor with reduced degrees of freedom. The contact bridge rotates coaxially about the tube, and is necessarily moved in sympathy with the compensation movement of the inner rotors. Without this coupling, the positive drive, and therefore the reproducibility of the compensation result, would not be achieved. This would lead to the situation in which, during the rapid switching processes of a circuit-breaker, the contact bridge would not be able to carry out in sympathy the full compensation movement of the plates, and therefore asymmetrical contact forces, incurred by the system, could occur, due, for example, to friction.

What is claimed is:

1. A rotor for an electric switch, comprising:

a rotor housing;

a rotatably mounted contact bridge including two movable contacts, the two movable contacts being configured to, by rotation of the rotor, interact with two fixed contacts of an electric switch to close or open a circuit, the rotatably mounted contact bridge being movably mounted in the rotor housing in a direction perpendicular to a direction of the contact bridge in a closed position;

a first plate in an interior of the rotor housing, arranged essentially perpendicular to the contact bridge;

two pairs of first and second spring pins; and two pairs of first and second springs, first ends of the respective pairs of springs being secured to the first spring pins, wherein the first spring pins lie on the contact bridge and the first plate, and second ends of the respective pairs of springs being secured to the second spring pins, wherein the second spring pins are secured to the first plate, such that, in the closed position of the rotor, a minimum contact pressure of the movable contacts of the contact bridge onto the fixed contacts is guaranteed, the second spring pins being movably mounted in the rotor housing.

2. The rotor for an electric switch of claim 1, wherein the rotatably mounted contact bridge is movably mounted in the rotor housing in a direction perpendicular to an axis of rotation of the contact bridge.

3. The rotor of claim 1, further comprising:

a second plate in the interior of the rotor housing, wherein the first spring pins lie on the contact bridge and the first and second plates, and wherein the second ends of the respective pairs of springs are secured to the second spring pins and wherein the second spring pins are secured to the first and second plates.

4. The rotor of claim 1, wherein the two pairs of first and second springs are formed as tension springs.

5. The rotor of claim 1, wherein the two plates and the contact bridge exhibit a middle recess, through which a guide pin is guidable, which serves as an axis of rotation of the rotor.

6. The rotor of claim 5, wherein the middle recess is formed as a longitudinal hole along a direction perpendicular to the direction of the contact bridge in the closed position.

7. The rotor of claim 3, wherein the first and second plates are connected to each other by a connection tube, and wherein the connection tube is guided through the middle recess of the contact bridge.

8. The rotor of claim 7, further comprising:

a guide pin as the axis of rotation of the rotor, guidable through the connection tube.

9. The rotor of claim 8, wherein the diameter of the guide pin is formed so relatively small in comparison with the internal diameter of the connection tube that the guide pin is mountable eccentrically in the connection tube.

10. The rotor of claim 1, wherein the second spring pins each respectively mounted in a notch of the rotor.

11. The rotor of claim 10, wherein the second spring pins are movably mounted in a direction perpendicular to the direction of the contact bridge in the closed position.

12. The rotor of claim 1, wherein the second spring pins are mounted floating in the rotor.

13. The rotor of claim 3, wherein the first and second plates are mounted floating in the rotor.

14. An electric switch comprising:

the rotor of claim 1; and two fixed contacts, the rotor being configured to interact with the two fixed contacts for opening or closing a circuit.

15. The rotor for an electric switch of claim 2, further comprising:

a first plate in an interior of the rotor housing, arranged essentially perpendicular to the contact bridge;

two pairs of first and second spring pins; and two pairs of first and second springs, first ends of the respective pairs of springs being secured to the first spring pins, wherein the first spring pins lie on the contact bridge and the first plate, and second ends of the respective pairs of springs being secured to the second spring pins, wherein the second spring pins are secured to the first plate, such that, in the closed position of the rotor, a minimum contact pressure of the movable contacts of the contact bridge onto the fixed contacts is guaranteed, the second spring pins being movably mounted in the rotor housing.

16. The rotor of claim 15, further comprising:

a second plate in the interior of the rotor housing, arranged essentially parallel to the contact bridge and to the first plate, wherein the first spring pins lie on the contact bridge and the first and second plates, and wherein the second ends of the respective pairs of springs are secured to the second spring pins and wherein the second spring pins are secured to the first and second plates.

17. The rotor of claim 15, wherein the two pairs of first and second springs are formed as tension springs.

18. The rotor of claim 16, wherein the first and second plates and the contact bridge exhibit a middle recess, through which a guide pin is guidable, which serves as an axis of rotation of the rotor.

19. The rotor of claim 18, wherein the middle recess is formed as a longitudinal hole along a direction perpendicular to the direction of the contact bridge in the closed position.

20. An electric switch comprising:

the rotor of claim 2; and two fixed contacts, the rotor being configured to interact with the two fixed contacts for opening or closing a circuit.

* * * * *